US006286263B1

(12) United States Patent
Burrill

(10) Patent No.: US 6,286,263 B1
(45) Date of Patent: Sep. 11, 2001

(54) SLIDING WINDOW TRACK COVER DEVICE

(76) Inventor: Vincent R. Burrill, 1803 Gene Cameron Way, Medford, OR (US) 97504

( * ) Notice: Subject to any disclaimer, the term of this patent is extended or adjusted under 35 U.S.C. 154(b) by 0 days.

(21) Appl. No.: 09/518,441

(22) Filed: Mar. 3, 2000

(51) Int. Cl.[7] ..... E06B 1/04
(52) U.S. Cl. ..... 49/472; 49/469; 49/470
(58) Field of Search ..... 49/440, 441, 442, 49/443, 444, 472, 473, 474, 483.1, 492.1, 493.1, 500.1, 505, 470, 469; 16/95 R, 85 R

(56) References Cited

U.S. PATENT DOCUMENTS

| | | | | |
|---|---|---|---|---|
| 3,349,519 | * | 10/1967 | Nehlig | 49/470 |
| 3,800,488 | * | 4/1974 | Swanson | 52/212 |
| 4,782,630 | * | 11/1988 | Kleyn | 49/505 |
| 4,856,241 | * | 8/1989 | Eriksson | 52/217 |
| 4,912,879 | * | 4/1990 | Mozuras et al. | 49/505 |
| 4,986,034 | * | 1/1991 | Mozuras et al. | 49/505 |
| 5,070,651 | * | 12/1991 | Jeter | 49/504 |
| 5,168,669 | * | 12/1992 | Knapp | 79/482 |
| 5,291,687 | | 3/1994 | Abad . | |
| 5,802,672 | * | 9/1998 | Rohder | 16/95 R |

* cited by examiner

*Primary Examiner*—Daniel P. Stodola
*Assistant Examiner*—Curtis Cohen
(74) *Attorney, Agent, or Firm*—Robert E. Howard

(57) ABSTRACT

A sliding window track cover that is adjustable to fit different window track widths and also acts as a window locking mechanism. The window track cover is comprised of a male and female subassembly fastened together. The female subassembly has a pair of spaced, parallel, longitudinally extending flange plate members, a longitudinally extending leg member attached to said flange plates along one longitudinal edge thereof, and a longitudinally extending shoulder member. The male subassembly has a longitudinally extending tongue plate, a longitudinally extending leg member attached to the tongue plate adjacent one longitudinal edge thereof, but inboard a distance sufficient to form a shoulder. The tongue plate of the male subassembly is inserted into the slot formed between the flange plates of the female subassembly a distance sufficient to cause the male and female leg members to be spaced apart a distance that is substantially the same as the distance between the side walls of a window track. Mating corrugations in one of the flange plate members and in the tongue plate member lock the two subassemblies into the selected configuration.

8 Claims, 2 Drawing Sheets

SLIDING WINDOW TRACK COVER DEVICE

BACKGROUND OF THE INVENTION

This invention relates to a window track cover device for use with horizontally sliding windows having a generally U-shaped track.

Over a period of time the exposed portion of the tracks of horizontally sliding windows tend to collect dust, dead insects, etc. Such tracks are hard to clean.

SUMMARY OF THE INVENTION

It is an object of the present invention to provide a cover for the exposed portion of the tracks of horizontally sliding windows.

It is a further object of the present invention to provide a window track cover that is adjustable to fit into tracks of different widths.

It is a still further object of the present invention to provide such a track cover which, secondarily, acts as a window locking mechanism.

These and other objects are achieved by providing an adjustable, substantially rigid window track cover which fits into generally U-shaped window tracks. The cover is comprised of an elongated male subassembly and an elongated female subassembly which fit together to form the track cover.

The male subassembly is comprised of a longitudinally extending tongue plate having upper and lower planar surfaces, longitudinal side edges and ends. A longitudinally extending male leg member depends from adjacent one longitudinal edge of the tongue plate, slightly inboard thereof to provide a longitudinally extending shoulder or ledge extending beyond the male leg. The lower surface of the tongue plate has a plurality of convex corrugations extending therefrom.

The female subassembly is comprised of longitudinally extending upper and lower flange plates which are spaced apart and substantially parallel, each flange plate having upper and lower planar surfaces, longitudinally extending side edges and ends. The flange plates are joined along one of their longitudinal side edges to the upper part of a longitudinally extending female leg member. The height of the slot formed between the upper and lower flange plates is substantially the same as the thickness of the tongue plate of the male subassembly. The female leg member extends downwardly from the juncture of the flange plates. A shoulder or ledge extends beyond the juncture of the flange plates and female leg member, at approximately the midpoint of the slot located between the flange plates, the major plane of the shoulder being substantially parallel to the major planes of the flange plates. The inner surface of the lower flange plate has a plurality of concave corrugations located therein.

The slot formed between the flange plates of the female subassembly is adapted to receive the tongue plate of the male subassembly. The material from which the female flange plates are made are sufficiently flexible to permit the ridges (apexes) of the convex corrugations of the male tongue plate to be pushed past the ridges of the female corrugations of the lower female plate until the male and female legs are spaced apart a distance substantially equivalent to the width of the window track. When the proper width is obtained, the convex corrugations of the male tongue plate are seated in the concave corrugations of the lower female flange plate to lock the subassemblies together.

The male and female legs of the thus assembled track cover are inserted into the widow track until the male and female shoulders abut the upper surfaces of the window tracks.

The shoulder and tongue plate of the male subassembly and the shoulder and upper flange plate of the female subassembly form a cover over the window track to prevent dirt, etc. from entering it. The length of the track cover is selected to extend between the end of the window track and the closed window seated in the track to prevent the window from being opened.

DESCRIPTION OF PREFERRED EMBODIMENTS

Window track cover device 10 is comprised of an elongated female subassembly 20 and an elongated male subassembly 30.

Figure 5:
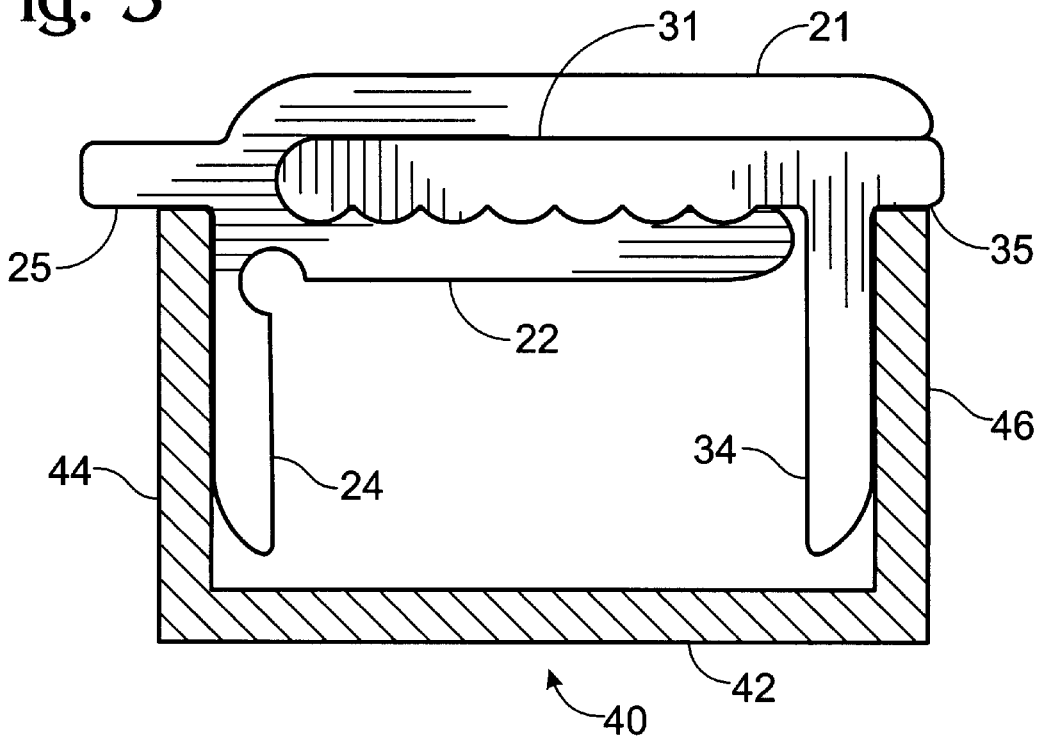
FIG. 5 is an end view of the track cover positioned within a U-shaped window track.

Female subassembly 20 is comprised of a longitudinally extending upper, horizontal, flange plate member 21 and a longitudinally extending lower, horizontal, flange plate member 22. The words "horizontal", "upper" and "lower" refer to the position of flange plate members 21 and 22 when track cover 10 is in use, as shown in FIG. 5. Upper and lower plate members 21 and 22 are substantially parallel to one another.

The outer and inner planar surfaces of upper flange plate member 21 are essentially smooth. The inner surface of lower flange plate member 22 has a plurality of concave corrugations 23 located therein. By "inner" is meant the planar surfaces of flange plates 21 and 22 facing each other; "outer" refers to the planar surfaces of flange plates 21 and 22 opposite the inner surfaces.

Flange plate members 21 and 22 are spaced apart a distance "d1", measured as the distance between the lower planar surface of upper flange plate 21 and the bottom of the furrows of concave corrugations 23 in lower flange plate member 22.

Flange plate members 21 and 22 are joined along one longitudinal edge to the longitudinally extending edge of female leg member 24. Female leg member 24 extends downwardly below lower flange plate member 22. The major plane of female leg member 24 angles slightly away (about 5 degrees) from a plane perpendicular to flange plates 21 and 22.

A longitudinally extending, horizontal, female shoulder 25 extends away from the upper part of female leg member 24. The upper planar surface of female shoulder 25 is substantially coplanar with the lower planar surface of upper flange plate 21. The lower planar surface of female shoulder 25 is substantially coplanar with a plane contacting the ridges of concave corrugations 23.

A groove 26 provides space for female leg member 24 to be moved from its angled position to a position substantially perpendicular to flange plates 21 and 22.

The space between flange plates 21 and 22 forms a longitudinally extending slot 27.

Male subassembly 30 is comprised of a longitudinally extending, horizontal, tongue plate member 31. The outer planar surface of tongue plate 31 is essentially smooth. The inner surface of tongue plate 31 has a plurality of convex corrugations 33 extending therefrom. The words "horizontal", "outer", and "inner" refer to the position of tongue plate 31 when the track cover 10 is in use, as shown in FIG. 5.

The thickness "d2" of tongue plate member 31 is essentially the same as the distance "d1" between flange plate members 21 and 22 of female subassembly 20.

A longitudinally extending male leg member 34 extends downwardly from the lower surface of tongue plate 31 a distance from the adjacent longitudinal edge of tongue plate 31 sufficient to provide for a longitudinally extending, horizontal, male shoulder member 35. The depth of male shoulder 35 is about one-half the depth of female shoulder 25 for reasons which will be explained below.

Similar to female leg member 24, the plane of male leg member 34 angles slightly away (about 5 degrees) from a plane perpendicular to tongue plate 31.

Figure 1:
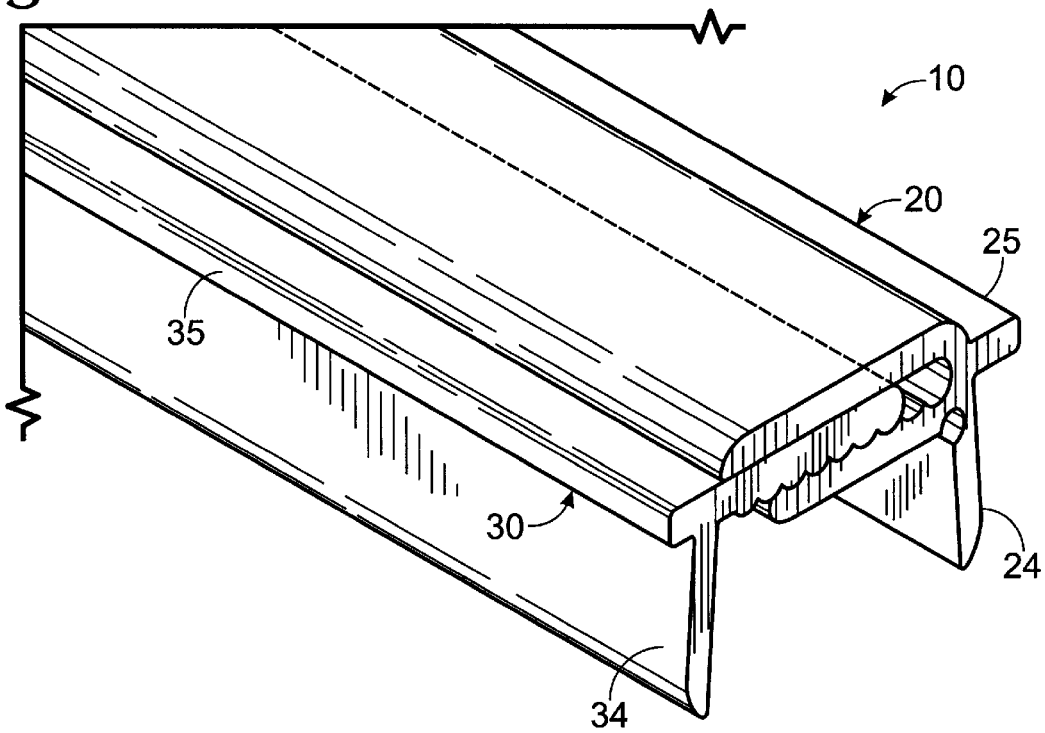
FIG. 1 is a partial perspective view of the window track cover device of the present invention.
Figure 2:
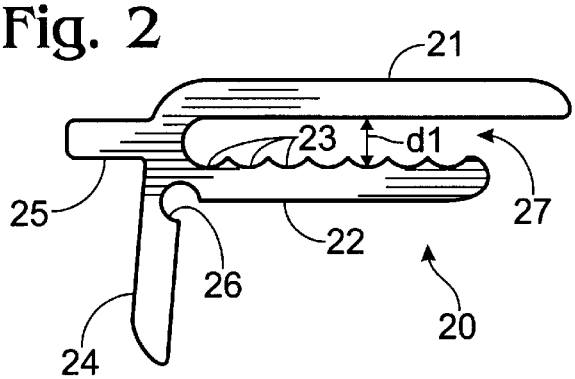
FIG. 2 is an end view of the female subassembly.
Figure 3:
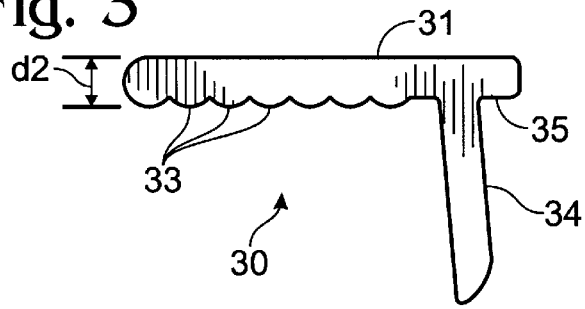
FIG. 3 is an end view of the male subassembly.
Figure 4:
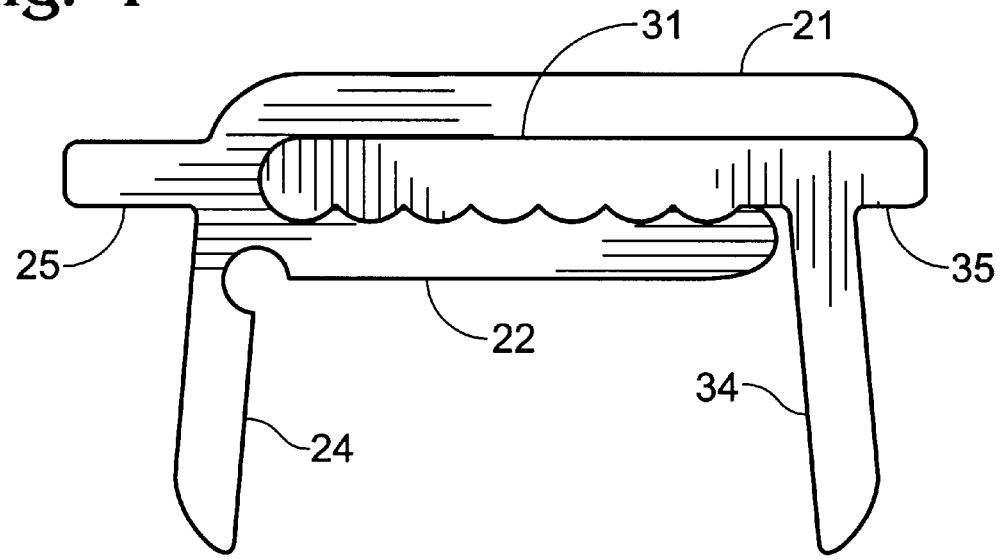
FIG. 4 is an end view of the female and male subassemblies joined together to form the window track cover device of the present invention.

The female and male subassemblies 20 and 30 are joined together to form the window track cover device 10 of the present invention as shown in FIG. 4. Tongue plate 31 of male subassembly 30 is inserted into slot 27 of female subassembly 20. Lower flange plate 22 is not as wide as upper flange plate 21 in order to accommodate male leg member 34.

In FIG. 4 tongue plate 31 is shown as being fully inserted into slot 27 with the convex corrugations 33 seated in concave corrugations 23. However, in use, the distance between the two rails of a U-shaped window track is first measured and tongue plate 31 is inserted into slot 27 a distance such that the space between the outer surfaces of legs 24 and 34 at their juncture with shoulders 25 and 35 is essentially the same as the space between the window track rails.

This can be better seen in FIG. 5 which is an end view of the window track cover device 10 inserted into a U-shaped window track 40. Window track 40 has a bottom 42, an outside side wall 44 and an inside side wall 46. Tongue plate 31 is inserted into slot 27 a distance such that the outer surfaces of legs 24 and 34, when compressed from their uncompressed angled configuration to a vertical configuration, fit snugly against the inside surfaces of walls 44 and 46 of track 40. A snug fit is further assured by the spring action of legs 24 and 34 trying to regain their uncompressed angled configuration which causes them to push against the inner surfaces of track walls 44 and 46.

As can be seen in FIG. 5, female shoulder 25 is deeper than male shoulder 35 and extends further away from outside track wall 44 than male shoulder 35 extends away from inside track wall 46. The reason for this is that female shoulder 25 is designed to be placed against the "outside" track 44, i.e., the track closest to the inside of the room in which the window is located, to thereby provide a better finger grip when cover device 10 is removed from track 40. Male shoulder 35 is designed to abut the "inside" track 46, i.e., the track located adjacent the fixed glass portion of the sliding window and cannot, therefore, be as deep as female shoulder 25 because of space considerations.

It is preferred that elongated female subassembly 20 and elongated male subassembly 30 be made of a thermoplastic material, such as polyvinyl chloride, and the subassembly profiles extruded so that all of the components of each of the respective female or male subassembly are integral with each other.

The extruded profiles can be cut to a length sufficient to provide track covers for several windows, the final length being measured and cut at the job site. Alternatively, the extruded profiles can be cut to lengths for standard window sizes immediately after extrusion.

The invention claimed is:

1. A sliding window track cover device comprising:

a female subassembly having upper and lower longitudinally extending flange plate member, said upper flange plate member being spaced apart and substantially parallel to said lower flange plate member to form a longitudinally extending slot, said upper flange plate member having a first longitudinal edge in alignment with a first longitudinal edge of said lower flange plate member, each of said upper and lower flange plate members having outer planar surfaces that are substantially parallel, said upper and lower flange plate members being joined at their first longitudinal edges with a longitudinally extending female leg member, said female leg member extending downwardly from said upper and lower flange plate members, said female leg member having substantially parallel inner and outer planar surfaces, said female leg member having a major plane which is angled away from a plane perpendicular to said upper planar surface of said upper flange plate member, and a longitudinally extending female shoulder member attached to, extending perpendiculary outwardly from said female leg member, said female shoulder member having an upper planar surface that is substantially coplanar with the lower planar surface of said upper flange plate;

a male subassembly having a longitudinally extending tongue plate member, said tongue plate member having outer and inner planar surface that are substantially parallel, said tongue plate member being joined to a longitudinally extending male leg member adjacent a first longitudinal edge of said tongue plate member, said male leg member extending downwardly from said tongue plate member, said m ale leg member having substantially parallel inner and outer planar surfaces and a major plane which is angled away from a plane perpendicular to said tongue plate member, the distance between said first longitudinal edge of said tongue plate member and the outer planar surface of said male leg member forming a male shoulder member connected at said first longitudinal edge and extending perpendiculary therefrom;

said tongue plate member being positioned in said slot formed between said flange plate members with said female and male leg members extending downwardly.

2. The sliding window track cover device of claim 1 wherein said inner surface of said lower flange plate member has a plurality of longitudinally extending concave corrugations located therein and said inner surface of said tongue plate member has a plurality of longitudinally extending convex corrugations therein, said concave corrugations releasably mating with said convex corrugations and adapted to allow adjustment of the distance between said female and male legs.

3. The sliding window rack cover of claim 1 wherein the distance between the outer surface of said female leg where it is joined with said upper and lower flange plate members and the outer surface of said male leg where it is joined with said tongue plate member is adapted to be substantially the same as the width of a sliding window track with which said sliding window track cover device is to be used.

4. The sliding window track cover of claim 1 wherein said female shoulder extends outwardly from said female leg member a distance adapted to extend beyond an adjacent sliding window track with which said sliding window track cover device is to be used to thereby provide a finger grip for removing said sliding window track cover from a sliding window track in which said sliding window track cover has been placed.

5. The sliding window track cover of claim 1 wherein the major plane of said female leg member is angled away from the plane perpendicular to said upper planar surface of said upper flange plate member by about five degrees, and the major plane of said male leg member is angled away from the plane perpendicular to said tongue plate member by about five degrees.

6. The sliding window track cover of claim 1 including a longitudinal groove where the inner surface of said female leg joins with the outer surface of said lower flange plate member.

7. The sliding window track cover of claim 1 wherein said lower flange plate member a width less than that of said upper flange member, said width of said lower flange plate member adapted to allow said tongue plate member to be fully inserted into said longitudinally extending slot.

8. The sliding window track cover of claim 1 wherein said female and male legs are adapted to have a length less than the depth of a sliding window track into which said sliding window track cover is to be placed.

* * * * *